US006543400B1

(12) United States Patent
Urckfitz et al.

(10) Patent No.: US 6,543,400 B1
(45) Date of Patent: Apr. 8, 2003

(54) OIL SUPPLY ROUTE IN A CAMSHAFT FOR A CAM PHASER

(75) Inventors: Jason M. Urckfitz, Brockport, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/045,728

(22) Filed: Oct. 19, 2001

(51) Int. Cl.[7] ..... F01L 1/34

(52) U.S. Cl. ..... 123/90.17; 123/90.15; 123/90.31; 123/90.34; 123/90.37; 464/2

(58) Field of Search ..... 123/90.15, 90.17, 123/90.31, 90.34, 90.37; 74/567, 568 R; 464/1, 2, 160

(56) References Cited

U.S. PATENT DOCUMENTS 5,058,539 A * 10/1991 Saito et al. ..... 123/90.17
5,197,421 A * 3/1993 Hara ..... 123/90.17
5,203,290 A * 4/1993 Tsuruta et al. ..... 123/90.17
5,875,751 A * 3/1999 Strauss et al. ..... 123/90.17
6,035,818 A * 3/2000 Sato et al. ..... 123/90.17
6,079,382 A * 6/2000 Schafer et al. ..... 123/90.17
6,283,075 B1 * 9/2001 Schafer et al. ..... 123/90.17
6,363,897 B2 * 4/2002 Scheidt et al. ..... 123/90.17

* cited by examiner

*Primary Examiner*—Thomas Denion
*Assistant Examiner*—Kyle M. Riddle
(74) *Attorney, Agent, or Firm*—Patrick M. Griffin

(57) ABSTRACT

A cam phaser assembly having an improved configuration of the C1 oil gallery in the camshaft supplying oil to the cam phaser. An axial bore in the camshaft is formed over its non-threaded outer portion at a diameter substantially greater than the diameter of the bolt connecting the phaser to the camshaft. Upon assembly of the cam phaser to the camshaft, an annular, cylindrical gallery is formed between the bolt surface and the bore, which gallery replaces the plurality of axial bores required for the C1 gallery in the prior art camshaft. The prior art C2 gallery, which utilizes a second axial bore in the bolt itself, is substantially unchanged, and an O-ring around the cam bolt in the first axial bore seals the C1 and C2 pressure galleries from communicating with each other.

9 Claims, 3 Drawing Sheets

OIL SUPPLY ROUTE IN A CAMSHAFT FOR A CAM PHASER

TECHNICAL FIELD

The present invention relates to cam phasers for reciprocating internal combustion engines for altering the phase relationship between valve motion and piston motion; more particularly, to cam phasers which are mountable on the front or forward ends of camshafts and which are supplied with pressurized engine oil from the camshaft oil supply; and most particularly, to an improved cam phaser assembly having an improved oil supply route through a camshaft.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds.

Typically, cam phasers employ a first element driven in fixed relationship to the crankshaft and a second element adjacent to the first element and mounted to the end of the camshaft in either the engine head or block.

In the known art, the first element is typically a cylindrical stator mounted coaxially to a crankshaft-driven gear or pulley and having a plurality of radially-disposed chambers and an axial bore, and the second element is a vaned rotor mounted to the end of the camshaft through the stator bore and having a vane disposed in each of the stator chambers such that limited relative rotational motion is possible between the stator and the rotor. The chambers are sealed typically by front and rear face seals of the stator. The camshaft and phaser are provided with suitable porting so that hydraulic fluid, for example, engine oil under engine oil pump pressure, can be brought to bear controllably on opposite sides of the vanes in the chambers. Control circuitry and valving, commonly a multiport spool valve, permits the programmable control of the volume of oil on opposite sides (C1 and C2) of each vane to cause a change in rotational phase between the stator and the rotor, in either the rotationally forward or backwards direction, thus advancing or retarding the timing of the valve opening and closing with respect to the pistons.

A serious problem is known in the art of manufacturing engines having cam phasers. Typically, the end portion of the camshaft which interfaces with the phaser requires substantial drilling and machining to provide hydraulic porting for the phaser. Specifically, in the prior art, the C1 oil gallery routing includes an annular groove in the camshaft at the cam bearing intersected by a plurality of bores drilled axially along the camshaft from the cam end. Another annular groove in the cam phaser intersects the bores to complete the routing. Drilling of the camshaft to provide the axially-directed bores is not easily and inexpensively performed, especially on chilled cast iron camshafts, because the bores are necessarily quite long and quite small in diameter. Further, being of small diameter, the bores can significantly reduce the pressure of oil being supplied to the cam phaser.

What is needed is an improved C1 oil gallery configuration in the camshaft that is easier and less expensive to manufacture and that improves the flow of oil to a cam phaser.

SUMMARY OF THE INVENTION

The present invention is directed to an improved configuration of the C1 oil gallery in a camshaft bolted to, and supplying oil to, a cam phaser. In the prior art, a first axial central bore in the camshaft is threaded over a portion of its outer end for receiving an axial bolt for securing a cam phaser to the camshaft. In the present invention, the axial bore is formed over a non-threaded outer portion at a diameter substantially greater than the diameter of the bolt. Upon assembly of the cam phaser to the camshaft, an annular, cylindrical gallery is formed between the bolt surface and the bore, which gallery replaces the plurality of axial bores required for the C1 gallery in the prior art. The prior art C2 gallery, which utilizes a second axial bore in the bolt itself, is substantially unchanged, and an O-ring around the cam bolt in the first axial bore seals the C1 and C2 pressure galleries from communicating with each other.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
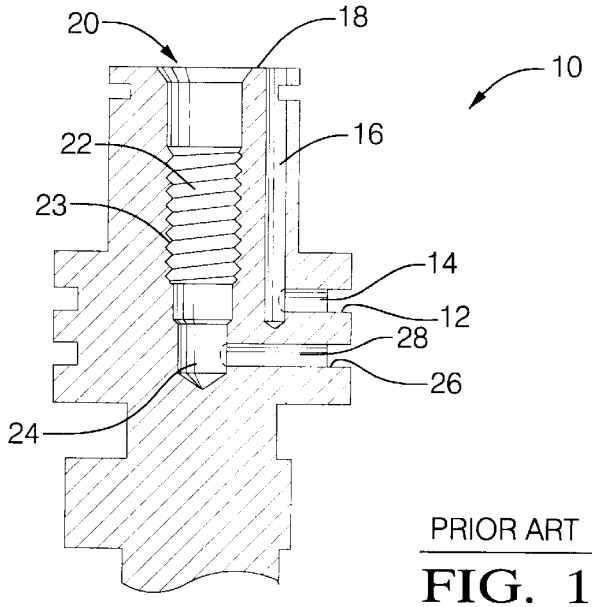
PRIOR ART FIG. 1
FIG. 1 is an elevational cross-sectional view of the outer end of a prior art camshaft, showing prior art oil galleries machined for providing C1 and C2 oil to a cam phaser.

Referring to FIG. 1, a prior art camshaft 10 includes a first annular groove 12 formed in an outer surface thereof and connected by one or more first radial bores 14 to one or more axially-directed bores 16 opening on camshaft end 18. A blind axial bore 20 extending from end 18 is stepped from a first diameter portion 22 to a narrower diameter portion defining a well 24 at the distal end thereof. Portion 22 is provided with female threads 23. A second annular groove 26 separated by an axial distance from first annular groove 12 is connected to well 24 by one or more second radial bores 28.

Figure 2:
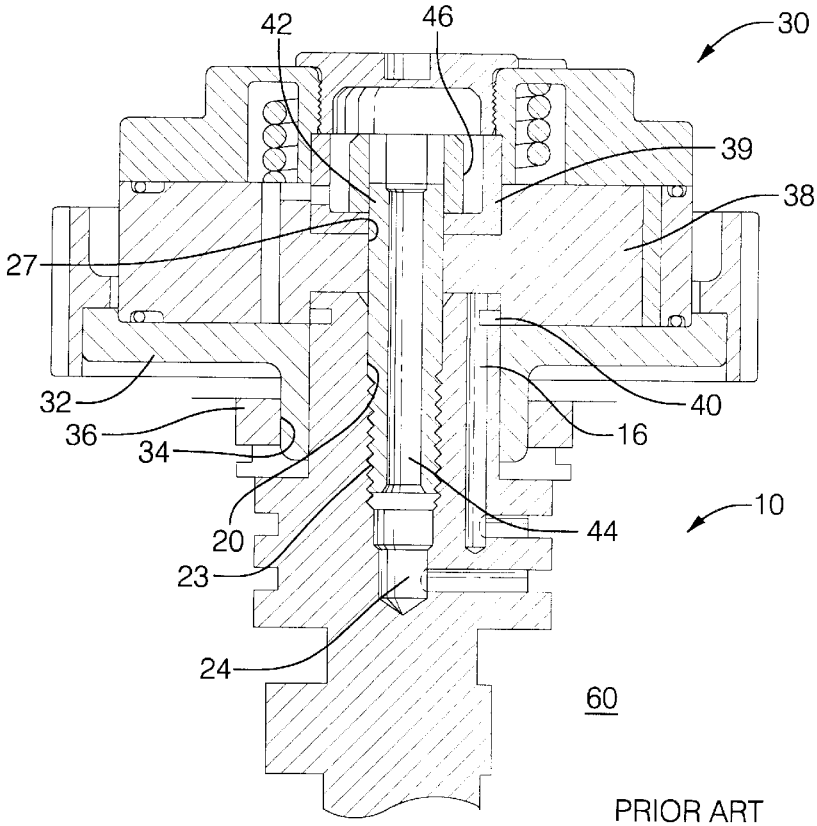
PRIOR ART FIG. 2
FIG. 2 is an elevational cross-sectional view of the prior art camshaft shown in FIG. 1, shown with a cam phaser bolted thereto.

Referring to FIG. 2, a vane type cam phaser 30 is shown attached to prior art camshaft 10, and part of internal combustion engine 60. Phaser 30 is well known in the art. A flanged hub 32 of the phaser is fitted to the camshaft and extends in a bore 34 formed in engine 36 for snugly receiving hub 32. Camshaft 10 extends into phaser 30 beyond hub 32, camshaft end 18 mating with vaned rotor 38 having C1 oil distribution passages 40 communicating with camshaft bores 16. Bolt 42 extends through a central aperture 27 in phaser 30 into bore 20 and thereby secures phaser 30 to camshaft 10 via threads 23. Bolt 42 terminates outside of well 24 and has an axial bore 44 in communication between well 24 and a C2 oil distribution annulus 46 in outer hub 39.

In operation, oil is provided conventionally via a known supply control means (not shown) to camshaft 10 as required. C1 oil, for retarding rotor 38, is supplied to groove 12 and ascends through bores 16 to passages 40. C2 oil, for advancing rotor 38, is supplied to groove 26 and ascends through bore 44 to annulus 46.

Figure 3:
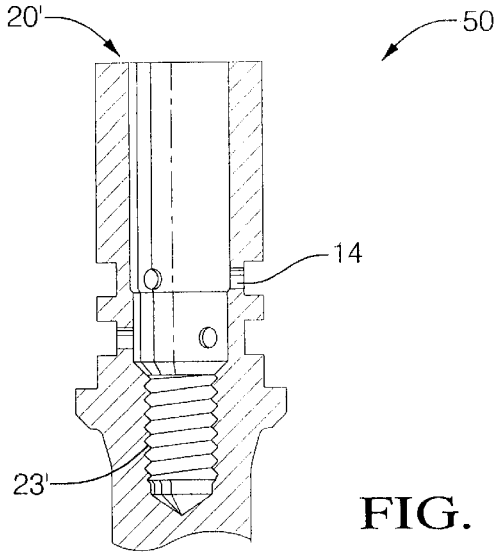
FIG. 3 is an elevational cross-sectional view of the outer end of a camshaft, machined in accordance with the invention for providing C1 and C2 oil to a cam phaser.
Figure 4:
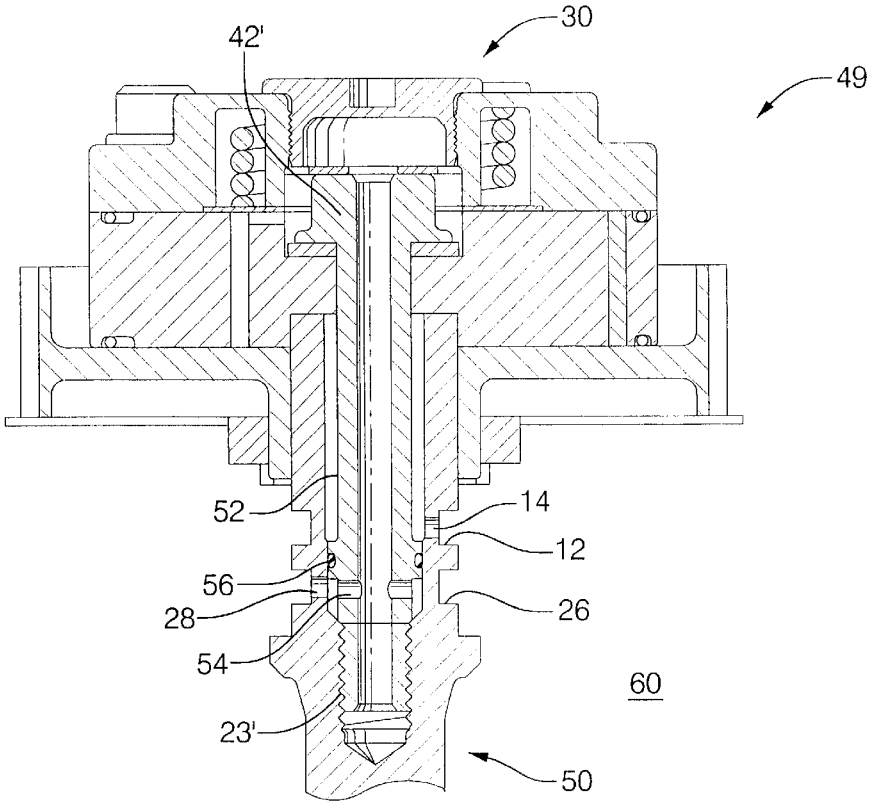
FIG. 4 is an elevational cross-sectional view of the improved camshaft shown in FIG. 3, shown with a cam phaser bolted thereto.
Figure 5:
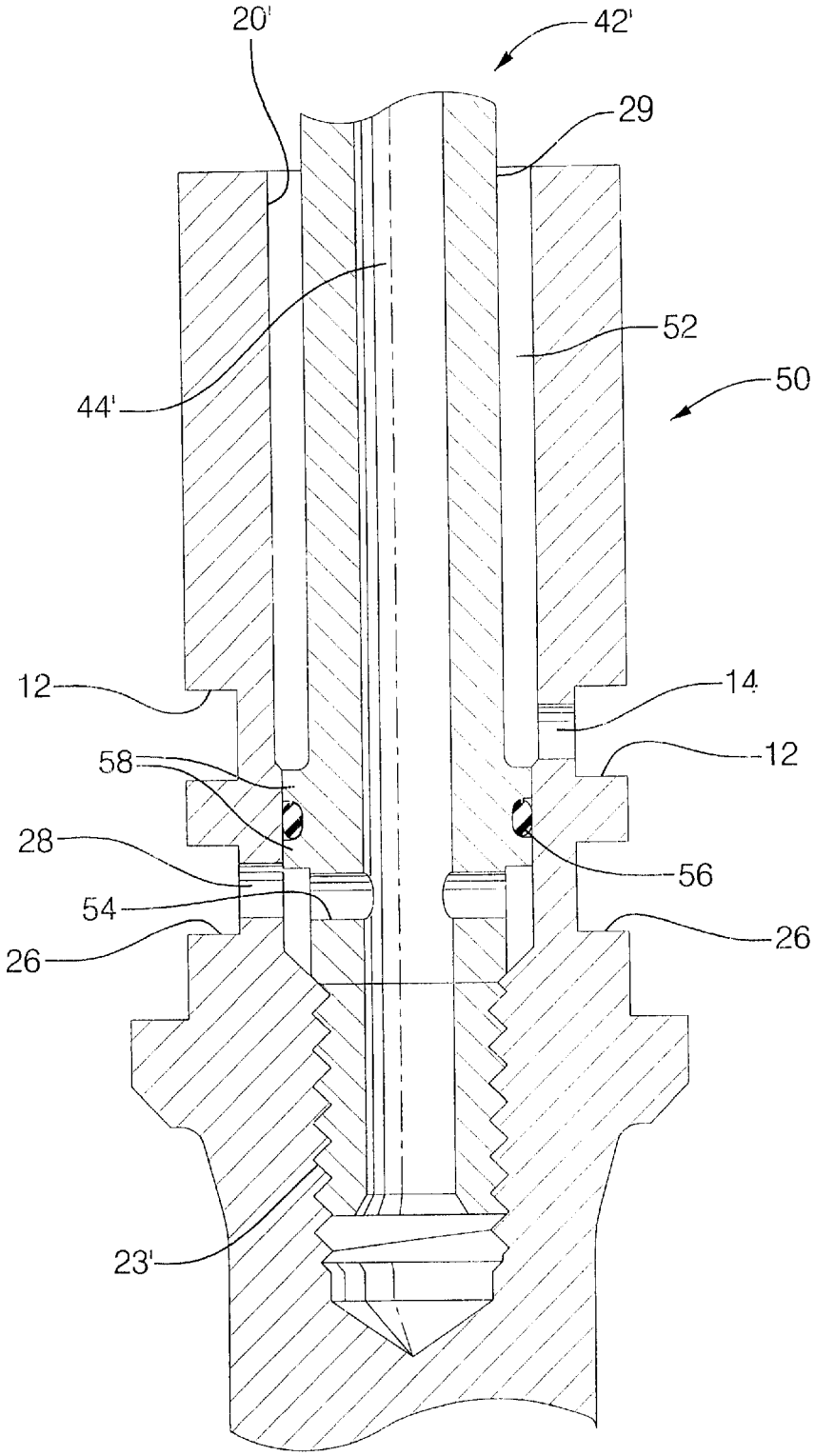
FIG. 5 is an enlarged and detailed view of a portion of FIG. 4, showing the relationship of the cam phaser bolt to the oil galleries in the improved camshaft.

Referring to FIGS. 3 through 5, an improved cam phaser assembly 49 includes improved camshaft 50 in accordance with the invention, which is similar to prior art camshaft 10, but with the following differences.

The prior art plurality of axially-directed bores 16 is eliminated, and a larger-diameter blind axial bore 20' is provided. The diameter of the outer portion of bore 20' is substantially larger than the diameter 29 of improved bolt 42' such that an annular, cylindrical space 52 is provided therebetween when cam phaser 30 is assembled to improved camshaft 50. Radial bores 14 extend through the wall of camshaft 50 into space 52. Space 52 communicates (not shown in the section of FIG. 4) with C1 passages 40 in rotor 38. Threads 23' in bore 20' are provided at the distal end of bore 20' and well 24 is eliminated. Improved bolt 42' extends inwards of improved camshaft 50 beyond second radial bores 28 and is provided with radial bores 54 to connect bores 28 with bolt axial bore 44', thus providing a pathway for C2 oil from groove 26 to rotor 38. First radial bores 14 are sealed from second radial bores 28 by an O-ring 56 disposed on bolt 42' between bores 14 and 28. Preferably, O-ring 56 is retained on bolt 42' by a pair of radial flanges 58 formed in bolt 42', as shown in FIG. 5.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. For example, a cam phaser may be readily reconfigured to accept C1 oil through bolt axial bore 44' and C2 oil through annular space 52. Such embodiments are within the scope and spirit of the invention. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A camshaft phaser assembly for shifting rotational phase between an engine crankshaft and camshaft, comprising:

a) a camshaft having a blind axial bore of a first diameter extending inwards from an end of said camshaft, and first and second annular grooves formed in an outer surface of said camshaft for supplying advancing and retarding oil to said assembly, said grooves being axially spaced apart and communicating via first and second radial bores, respectively, with said blind axial bore;

b) a cam phaser disposed on said end of said camshaft and having distribution passages therein for advancing and retarding oil and having a central aperture; and c) a bolt disposed through said central aperture and threadedly engaged in said blind axial bore for securing said phaser to said camshaft, said bolt having a second diameter less than said first diameter such that an annular oil passage is provided in said assembly between said bolt and said blind axial bore communicating between said first annular groove and said cam phaser, said bolt having an axial bore communicating with said second radial bore in said camshaft for providing one of said advancing and retarding oil to said phaser.

2. A cam phaser assembly in accordance with claim 1 further comprising a seal disposed in said blind axial bore between said bore and said bolt to prevent communication between said advancing oil and said retarding oil.

3. A cam phaser assembly in accordance with claim 2 wherein said seal is an O-ring.

4. A cam phaser assembly in accordance with claim 1 wherein said bolt further comprises a radial bore in fluid communication with said second radial bore in said camshaft and said axial bore of said bolt.

5. A cam phaser assembly in accordance with claim 3 wherein said O-ring is retained by a plurality of radial flanges formed in said bolt.

6. A cam phaser assembly in accordance with claim 1, further comprising a distal end of said blind axial bore, wherein said bolt is threadedly engaged with said distal end of said blind axial bore.

7. A camshaft for an engine for mating with and providing actuating oil to a cam phaser, comprising:

a) a blind axial bore extending inwards from an end of said camshaft; and b) first and second annular grooves formed in an outer surface of said camshaft, said grooves being axially spaced apart and communicating via first and second radial bores, respectively, with said blind axial bore.

8. A camshaft in accordance with claim 4 wherein said blind axial bore is threaded over a distal portion of its length.

9. An internal combustion engine including a cam phaser assembly for shifting rotational phase between an engine crankshaft and camshaft, wherein said cam phaser assembly includes:

a camshaft having a blind axial bore of a first diameter extending inwards from an end of said camshaft, first and second annular grooves formed in an outer surface of said camshaft for supplying advancing and retarding oil to said assembly, said grooves being axially spaced apart and communicating via first and second radial bores, respectively, with said blind axial bore;

a cam phaser disposed on said end of said camshaft and having distribution passages therein for advancing and retarding oil and having a central aperture; and a bolt disposed through said central aperture and threadedly engaged in said blind axial bore for securing said phaser to said camshaft, said bolt having a second diameter less than said first diameter such that an annular oil passage is provided in said assembly between said bolt and said blind axial bore communicating between said first annular groove and said cam phaser, said bolt having an axial bore communicating with said second radial bore in said camshaft for providing one of said advancing and retarding oil to said phaser.

* * * * *